US005971792A

United States Patent [19]

Lin

[11] Patent Number: 5,971,792

[45] Date of Patent: Oct. 26, 1999

[54] PATCH PLUG

[75] Inventor: Mike H. Lin, Cerritos, Calif.

[73] Assignee: International Connectors and Cable Corporation, Cerritos, Calif.

[21] Appl. No.: 08/901,291

[22] Filed: Jul. 14, 1997

[51] Int. Cl.[6] ..... H01R 4/24

[52] U.S. Cl. ..... 439/404

[58] Field of Search ..... 439/403, 401, 439/404

[56] References Cited

U.S. PATENT DOCUMENTS

| | | | |
|---|---|---|---|
| 3,692,966 | 9/1972 | Lancaster | 439/61 |
| 3,874,763 | 4/1975 | Hoover | 439/345 |
| 3,901,575 | 8/1975 | Hoover | 439/342 |
| 4,080,040 | 3/1978 | Lancaster | 439/43 |
| 5,226,835 | 7/1993 | Baker, III et al. | 439/403 |
| 5,266,042 | 11/1993 | Hampel | 439/669 |
| 5,460,545 | 10/1995 | Siemon et al. | 439/308 |
| 5,601,447 | 2/1997 | Reed et al. | 439/404 |
| 5,624,274 | 4/1997 | Lin | 439/417 |
| 5,634,817 | 6/1997 | Siemon et al. | 439/608 |

OTHER PUBLICATIONS

1996 ICC Premise Wiring Solutions Catalog—Jun. 1996.

*Primary Examiner*—Gary F. Paumen
*Assistant Examiner*—Briggitte R. Hammond
*Attorney, Agent, or Firm*—Christie, Parker & Hale, LLP

[57] ABSTRACT

A patch plug for connection to a 110-type connector block having a plurality of spaced apart electrical contacts. Each contact has an insulation displacement connector at a back end thereof and a contact blade at a front end thereof. A dielectric housing contains the spaced apart electrical contacts and maintains them aligned in a predetermined position such that the insulation displacement contacts are disposed rearwardly of the respective blades, are arranged upwardly, and are aligned in a single row transverse to the direction of insertion of the contact blades into the 110-type connector block. A contact protection block is formed around the single row of insulation displacement connectors and includes two outer side walls one at each end of the single row of insulation displacement connectors. Intermediate walls are located between and extending above the insulation displacement connectors of adjacent contacts.

18 Claims, 9 Drawing Sheets

PATCH PLUG

This invention relates to electrical connectors and, in particular, to a patch plug for electrically connecting a bundle of wires to a linear array of insulation displacement connectors.

BACKGROUND OF THE INVENTION

Modem commercial buildings include an abundance of communications equipment. Individual offices within the building are often equipped with telephones and fax machines, as well as computers that are interconnected with other computers through high speed communication networks. For ease of administration, apparatus for interconnecting such equipment (with each other and with outside networks) is centralized via interconnection (cross-connect) panels that serve the entire building.

A typical cross-connect panel includes several 110-type connector blocks each having an array of insulation displacement connectors (IDCs) for terminating large bundles of telephone wires. IDCs are commercially available and designed to facilitate making mechanical and electrical connection to a wire—particularly a wire that is surrounded by dielectric insulation. Each IDC includes a pair of opposing contact fingers that strip insulation from a wire that is pressed between the contact fingers so that an electrical contact is made between the wire and the IDC. Each IDC accommodates a single wire pressed between its opposing contact fingers, and is so compact that many IDCs can fit into a small area.

Several arrays of IDCs may be used to terminate a bundle of wire from a telephone central office while other arrays on the cross-connect panel may be used to terminate bundles of wire from telephone equipment within the building. Interconnecting particular wires from one bundle with particular wires from another bundle is accomplished with a patch cord comprising a cord with a plug (patch plug) attached to each end. The cord includes several wires within a plastic jacket. The patch plugs include a number of contact blades that are designed to be pressed into an equal number of IDCs within an array thereof. Once wired, a patch plug is a multiple wire connector that may be installed and removed from the cross-connect panel for the purpose of branching off existing lines or connecting together discrete areas of the terminal field.

One type of patch plug used in connection with the 110-type connector block is described in U.S. Pat. No. 5,226,835, which is incorporated herein by reference. The patch plug includes a two-piece dielectric housing which snaps together and captures several conductors therein. Each of the conductors includes an insulation displacement connector at one end for receiving individual wires from a cord and a contact blade at the other end for inserting into the IDCs of the 110-type connector block. A cord comprising a bundle of insulated wires, surrounded by an insulating jacket, is prepared for connection to the conductors by stripping away a small portion of the jacket to expose the insulated wires. The insulated wires may then be placed into the underside of the upper housing member which includes narrow channels for holding the wires in fixed positions. Thereafter, the upper housing member may be snapped onto the lower housing member by pressing them together. The wires are then collectively pressed/seated into the IDCs of the conductors. A disadvantage of this type of patch plug is that the IDCs are exposed and may be damaged or bent either before or during assembly. In addition, because termination tools may damage the exposed contacts, termination is typically done by hand, which can result in inefficiencies and excessive waste.

Another type of patch plug is described in U.S. Pat. No. 5,460,545. This patch plug includes an insulative plastic housing having three separable parts, a lower first housing, an upper second housing and a contact insulator housing. The patch plug also includes a plurality of connector contacts in the insulator housing, each contact having an IDC at one end and a blade portion at the other end. As with the previous patch plug, the IDCs of the contacts are exposed and subject to damage.

Both of the above mentioned patch cords also present additional difficulties. First, since the patch cords are limited in width size to permit installation of adjacent patch cords to the 110-type connecting block without missing terminal locations that may require access, a very tight clearance exists between the endmost insulation displacement connectors of the contacts and the side walls of the patch plug housing, inhibiting the use of a contact protection block around the connectors. Second, since the wires remain in the housing, they must be carefully trimmed, adding to installation time and the increased possibility of error. Failure to adequately trim can result, among other things, in wires being jammed between the termination cap and the rest of the housing, preventing proper termination. Third, it is difficult to remove these patch plugs once they are mounted to a termination block, especially when several patch plugs are mounted side-by-side, since it is difficult to build up a sufficient grasping force on the upper and lower surfaces of the plug housing when attempting to pull the plug out.

In view of the above, it should be appreciated that there is still a need for a patch plug that may be readily installed in the field by hand or by a punchdown tool and that may be readily removed and reinserted at a different location on the cross-connect panel having IDCs that are protected from damage.

SUMMARY OF THE INVENTION

The present invention is embodied in a patch plug having insulation displacement connectors that are protected from damage before and during assembly. The new patch plug also permits punchdown termination for a clean and secure connection or, alternatively, an easy to use housing cover may be employed for toolless termination without careful trimming of the wires being required prior to termination. In addition, the patch plug is contoured to permit easy removal and reinstallation onto a 110-type connector block.

The patch plug of the present invention includes a plurality of spaced apart electrical contacts. Each contact includes an insulation displacement connector at a back end thereof and a contact blade at a front end thereof. The contact blade is adapted for insertion into a 110-type connector block. A dielectric housing contains the spaced apart electrical contacts and maintains them aligned in predetermined positions such that the insulation displacement connectors are disposed rearwardly of their respective blades, are arranged upwardly, and are aligned in a single row transverse to the direction of insertion of the patch plug into the 110-type connector block.

A feature of the present invention is that a contact protection block is formed around the single row of insulation displacement connectors. The contact protection block has two outer side walls, one at each end of the single row of insulation displacement connectors, and intermediate walls located between and extending above the insulation displacement connectors of adjacent contacts. The contact protection block also defines a plurality of slots for receiving and guiding a plurality of communication wires, respectively, into conductive engagement with the insulation displacement connectors of the contacts. An advantage of the contact protection block is that it prevents damage to the contact pins prior to and during assembly.

In a preferred embodiment, the contact protection block extends the full width of the patch plug. Thus, a standard width may be maintained for the patch plug that is suitable for use with 110-type connector blocks, without missing terminal locations that may require access when the patch plugs are mounted immediately adjacent to each other.

In a further preferred embodiment, the contact protection block is part of a contact holder that receives and holds the plurality of spaced apart electrical contacts and that forms an upper lip at the front end of the patch plug partially defining the opening that exposes the contact blades for insertion into the 110-type connector block. Such a construction reduces the number of parts that otherwise would be required if the contact protection block were separately made.

Another feature of the present invention is that the housing may include a cover having a front edge that defines a plurality of wire channels for receiving a plurality of communication wires. An advantage of this feature is that the communication wires may be brought through and guided by the cover of the patch plug to provide easier field termination, since careful trimming is not required.

A further feature of the present invention is that the upper and lower exterior surfaces of the housing of the patch plug may be provided with gradual inclined or ramped surfaces increasing in depth in a longitudinal direction from an intermediate portion of the patch plug to a rear portion of the patch plug. The ramped surfaces permit easier removal and reinsertion of the patch plug at different locations of the 110-type connector block.

Other features and advantages of the present invention will become apparent from the following description of the preferred embodiments, taken in conjunction with the accompanying drawings, which illustrate, by way of example, the principles of the invention.

DETAILED DESCRIPTION OF THE PREFERRED EMBODIMENT

Figure 1:
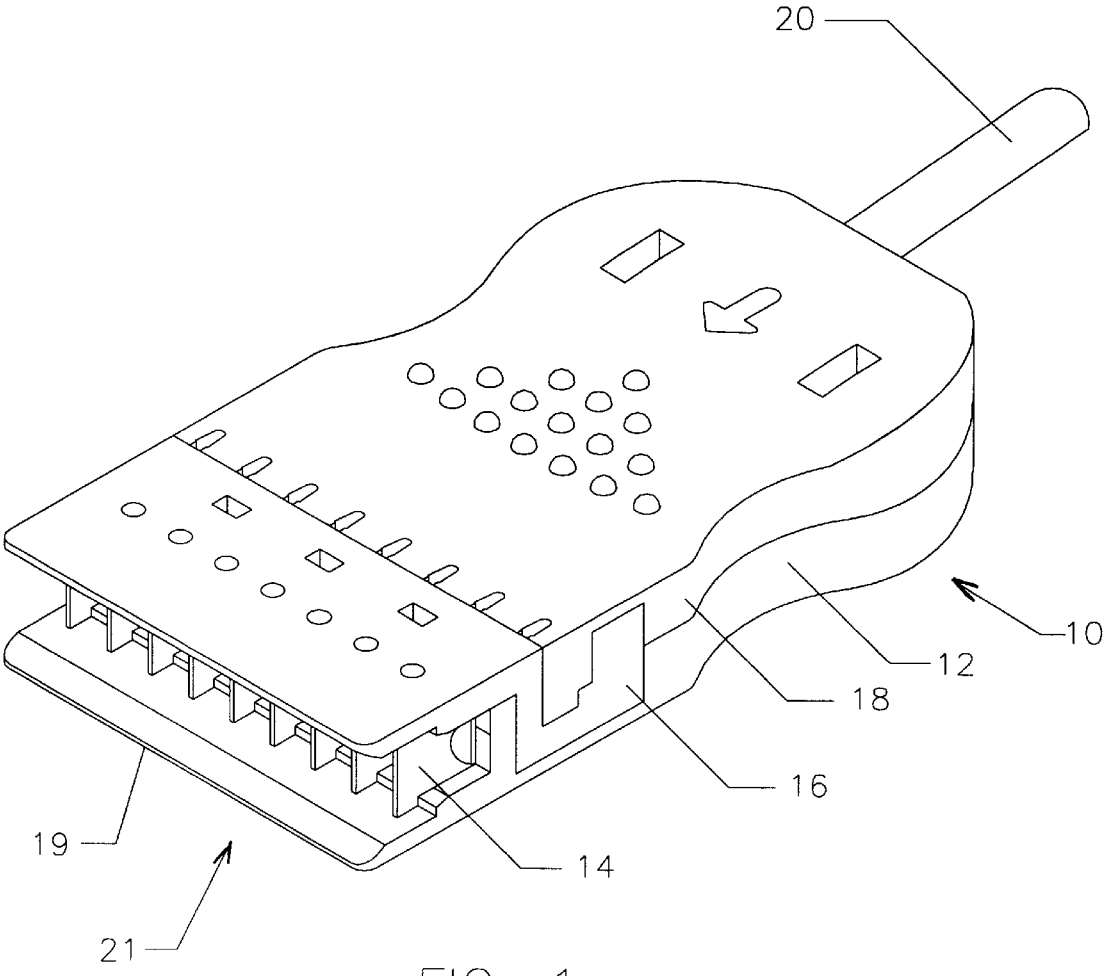
FIG. 1 is a top perspective view of an assembled patch plug according to the present invention.
Figure 2:
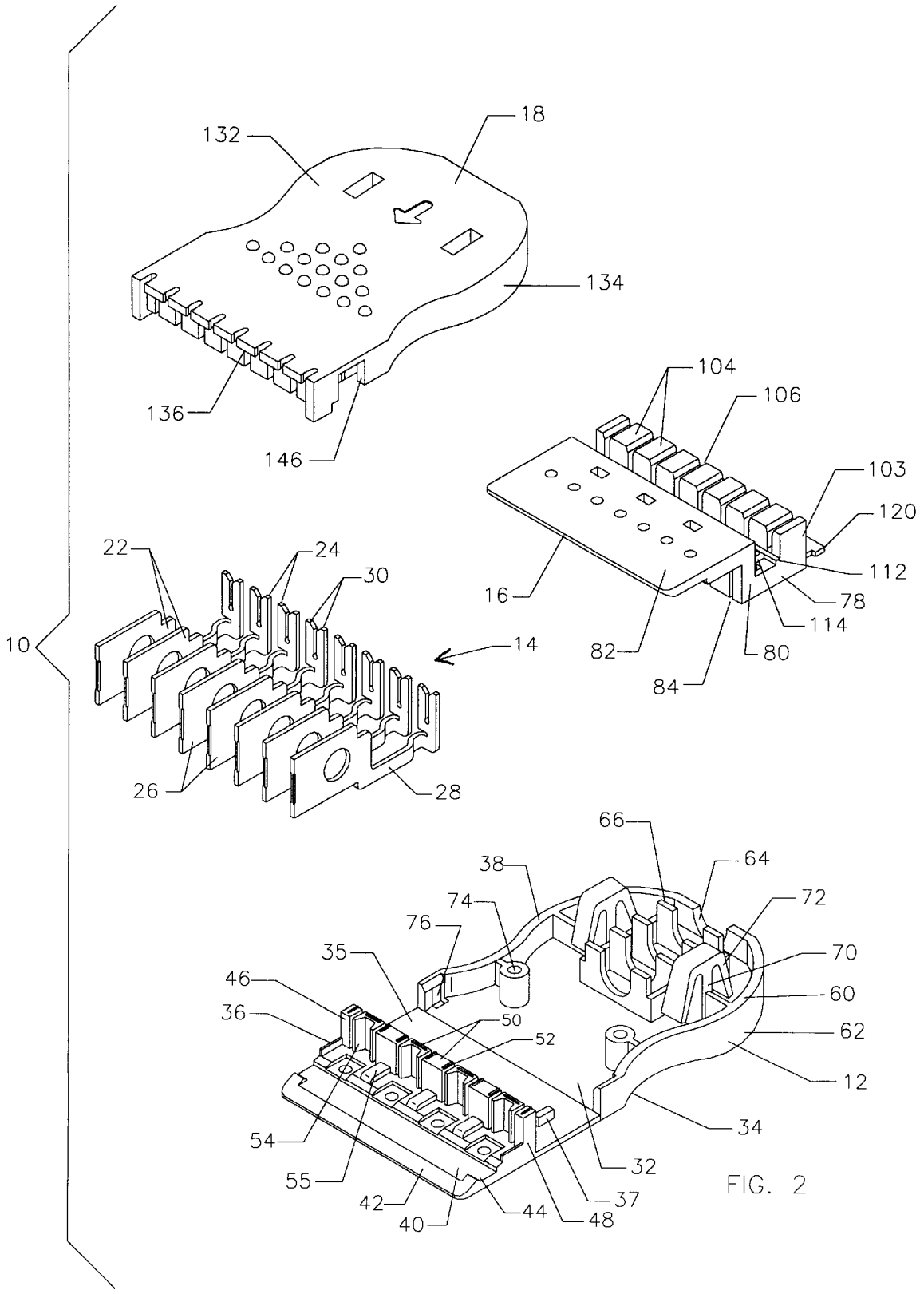
FIG. 2 is an exploded view of the patch plug shown in FIG. 1.

A patch plug 10 according to the present invention is shown in FIGS. 1 and 2. The patch plug includes a housing base 12, a plurality of spaced-apart electrical contacts 14, a contact holder 16 and a cover (or termination cap) 18. The housing base, contact holder and cover are each preferably made of a plastic dielectric material. A cord 20 having a plurality of insulated wires (not shown) may be terminated by the patch plug as described below. A front end 19 of the patch plug defines an opening 21 for receiving a 110-type connector block (not shown) such as an array of insulation displacement connectors (IDCs) from a cross-connect panel of the type described in U.S. Pat. No. 5,226,835.

In this case, the plurality of spaced-apart electrical contacts 14 includes eight contacts (or contact pins) 22, each contact having an upright insulation displacement connector 24 at one end for receiving an individual wire from the cord 20, a contact blade 26 at the other end for insertion into the IDC of a 110-type connector block and a connector portion 28 connecting the insulation displacement connector 24 and the contact blade 26. The insulation displacement connectors 24 each have forked edges 30 that can pierce the insulation of the wire to make a contact.

Figure 3A:
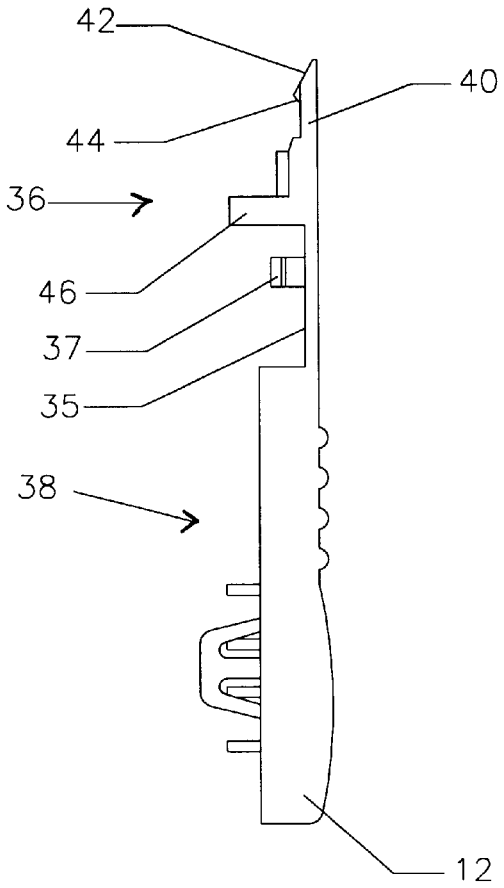
FIGS. 3A, 3B, and 3C are side, bottom and rear views, respectively, of a housing base of the patch plug according to the present invention.
Figure 3B:
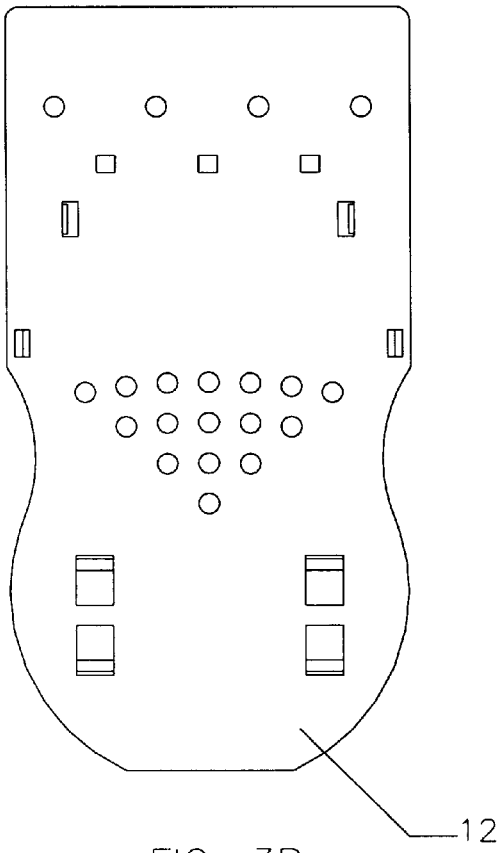
Figure 3C:
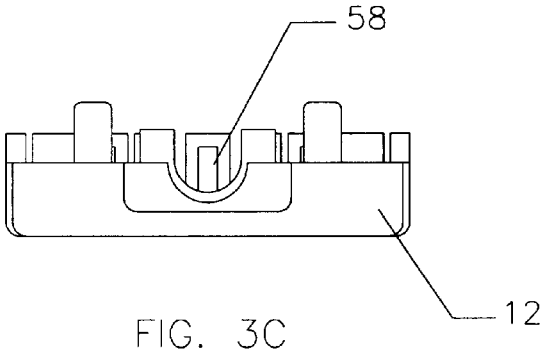

With reference also to FIGS. 3A–3C, the housing base 12 has an interior surface 32 and an exterior surface 34 and is divided into a front portion 36, a flat intermediate portion 35 (that may include posts 37 extending upwardly from the interior surface 32) and a back portion 38. The front portion includes a lower lip 40 that runs the full width of the housing base and defines the bottom boundary of the front opening 21 of the patch plug. A forward edge 42 of the front lip is beveled along the interior surface to more readily receive a 110-type connector block from a cross-connect panel. Inwardly from the beveled forward edge and extending upwardly from the interior surface at each side of the lower lip is a protrusion 44 for locking onto the 110-type connector block.

Spaced inwardly of the lower lip is a contact support 46 that preferably runs the full width of the housing base and extends upwardly from the interior surface. The contact support has two end walls 48 and is slotted between the end walls to form, in this case, seven interior columns 50 and eight slots 52 for receiving rear portions of the eight contact blades 26, respectively. Preferably, the front surface of alternate columns have channels 54 for mating with the 110-type connector block of the cross-connect panel. Similarly, keys 55 extend from the front of the remaining columns and are configured to mate with keyways of the 110-type connector block when mounted thereto. The channels 54 and keys 55 insure proper alignment and polarization of the patch plug to the 110-type connector block. The remaining columns also have recesses 58 extending up their backside from the interior surface 32 to a location near the top of the columns, which, as will be discussed, are used to secure the contact holder 16 to the housing base 12.

Figure 11:
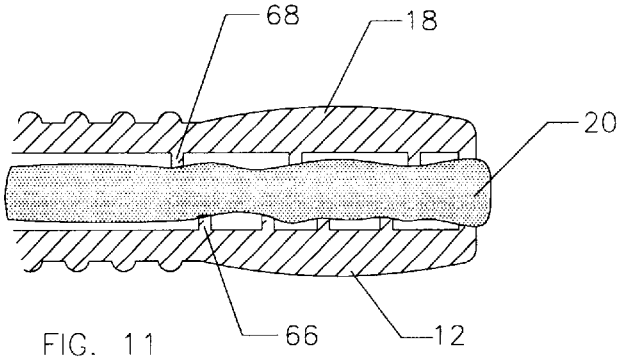
FIG. 11 is a partial cross section of the patch plug according to the present invention showing strain relief for a patch plug cord.
Figure 12:
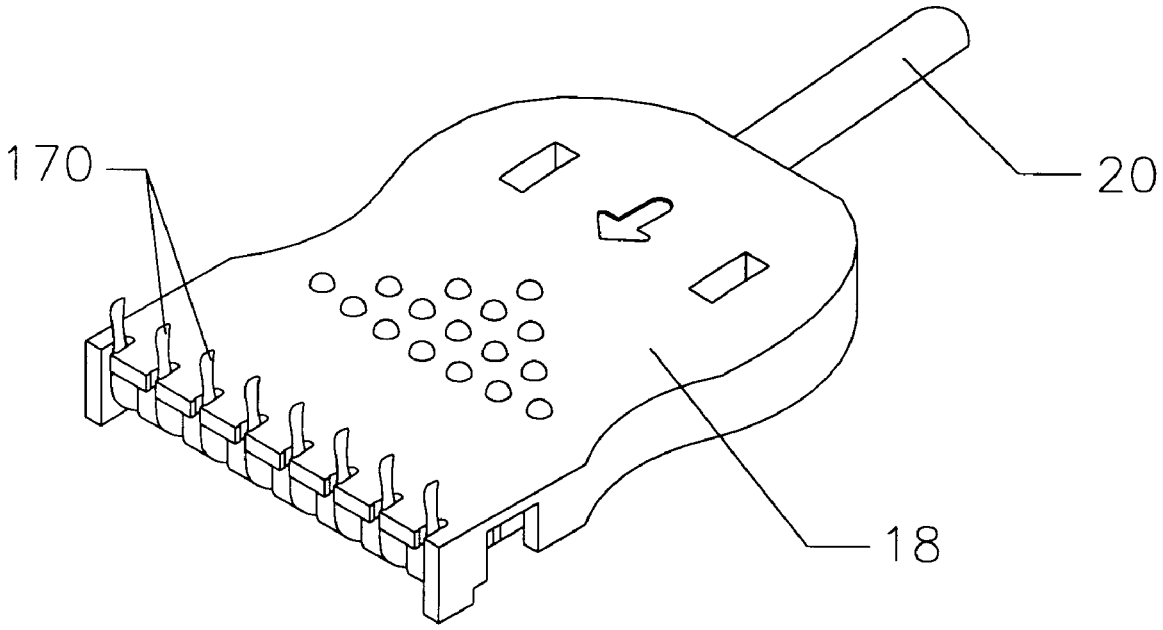
FIG. 12 is a perspective view of the cover with wires in the wire channels.

The back portion 38 of the housing base 12 includes an outer wall 60 extending up from the interior surface 32 and defining an exterior wall surface 62 of the housing. At its back end, the outer wall has a semicircular cutout 64 for receiving the cord 20. Inwardly from the cutout are a plurality of longitudinally spaced U-shaped uprights 66 that provide strain relief to the cord when mounted in opposed relation to similar uprights 68 of the cover 18 (see FIG. 11).

Extending upwardly from the interior surface of the housing base on each side of the U-shaped uprights 66 is a post 70. A pair of downwardly and outwardly extending resilient arms 72 depend from opposing sides of the uppermost end of each post, which, as will be discussed, are used for latching the cover to the housing base. Preferably, the back portion 38 also has base alignment holes 74 for perfectly aligning the cover to the housing base and recesses 76 on the inner surface of the outer wall adjacent the intermediate portion 35 of the housing base to assist in latching the contact holder to the housing base.

Figure 4A:
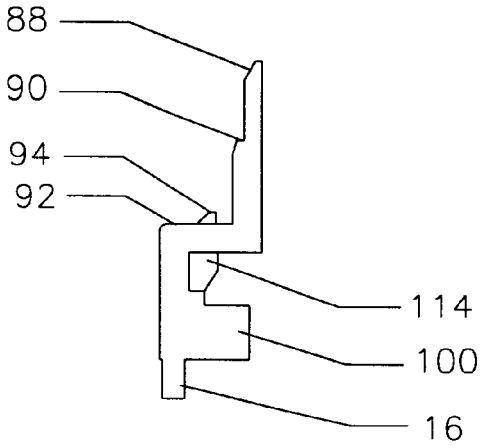
FIGS. 4A, 4B and 4C are side, top and bottom views, respectively, of a contact carrier of the patch plug according to the present invention.
Figure 4B:
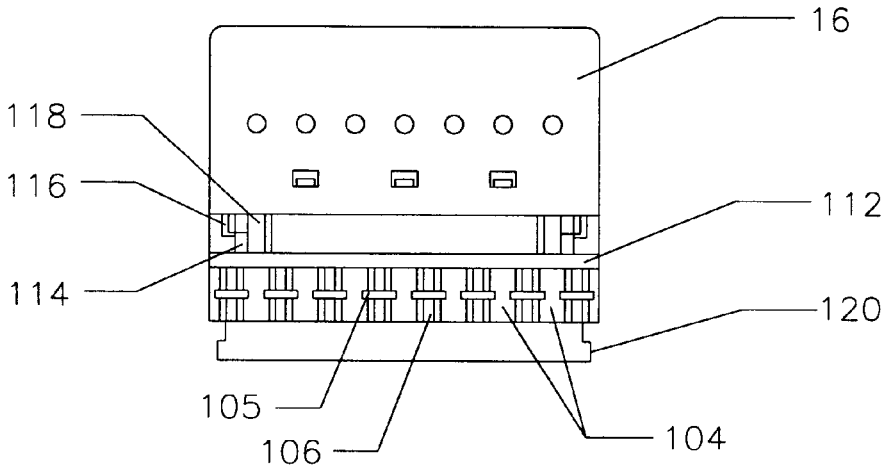
Figure 4C:
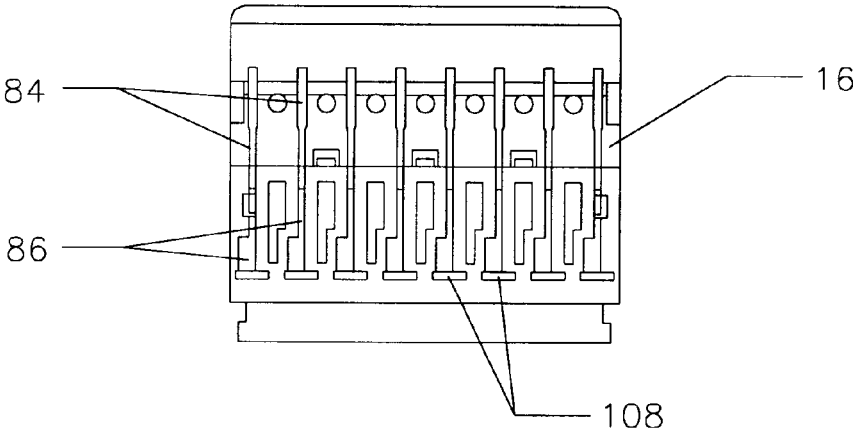

With reference also to FIGS. 4A–4C, the contact holder 16 includes a bottom plate 78, an upwardly extending rear wall 80, and an upper lip 82 extending in a forward direction from the rear wall. Preferably, the bottom plate, the rear wall and the upper lip all extend the full width of the patch plug and have grooves 84, 86 along their inner surfaces to receive and hold the contact blades 26 and connector portions 28, respectively, of the contacts 14.

Figure 6:
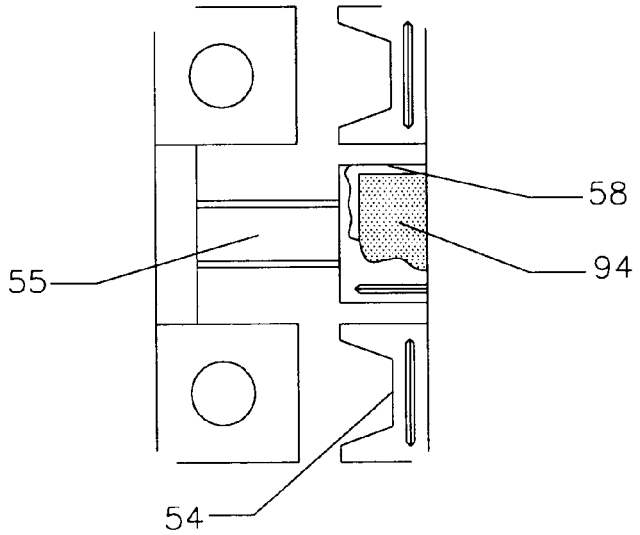
FIG. 6 is a top view of the housing base with a portion cut away to show an assembly detail.

A forward edge 88 of the upper lip is beveled along the interior surface to more readily receive a 110-type connector block. Inwardly from the beveled forward edge and extending downwardly from the interior surface is a ridge 90 running the fall width of the patch plug that acts as a stop when the patch plug is mounted to the 110-type connector block. An outwardly facing surface 92 of the rear wall 80 includes protrusions 94 that mate with the recesses 58 of the housing base to secure the contact holder to the housing base (see also FIG. 6).

Figure 9:
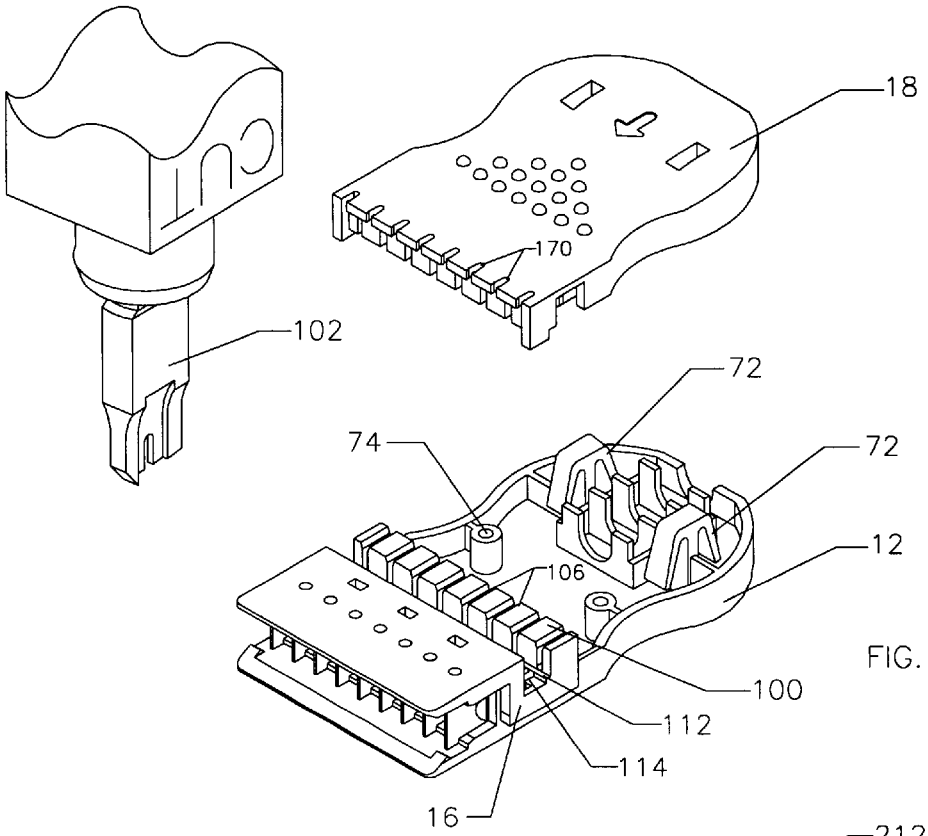
FIG. 9 is a perspective view of an assembled housing base and contact carrier with an unassembled cover according to the present invention.

The contact holder 16 includes a contact protection block 100 spaced sufficiently from the rear wall 80 to permit insertion of a punchdown tool 102 (see FIG. 9). Along the front of the contact protection block 100 is a tool block 112 which provides a sturdy base for use with a wire termination tool (e.g., a punchdown tool).

The contact protection block 100 preferably runs the full width of the patch plug. In this case, the contact protection block has two end walls 103 and is slotted to form seven interior columns 104 and eight slots 106 for receiving eight insulated wires (not shown). A widened portion 105 of the slot is provided at the mid-point of each slot to receive the insulation displacement connectors 24 of the contact pins 22. The insulation displacement connectors may enter the slots 106 through openings 108 in the bottom plate 78. The preferred contact protection block protects the front and back of the insulation displacement connectors from damage. Preferably, the columns 104 also extend above the insulation displacement connectors to further protect the contact pins.

Preferably, the bottom plate 78 includes an upwardly extending flange 114 secured between the rear wall 80 and the contact protection block 100. Each flange 114 includes a protrusion 116, which, as described later, may be used for securing the cover 18 to the contact holder 16. Adjacent each flange is a hole 118 in the bottom plate for receiving the posts 37 of the intermediate portion 35 of the housing base 12. The bottom plate 78 may also extend rearwardly of the contact protection block and may be provided with laterally extending latches 120 to engage recesses 76 of the housing base.

Figure 5:
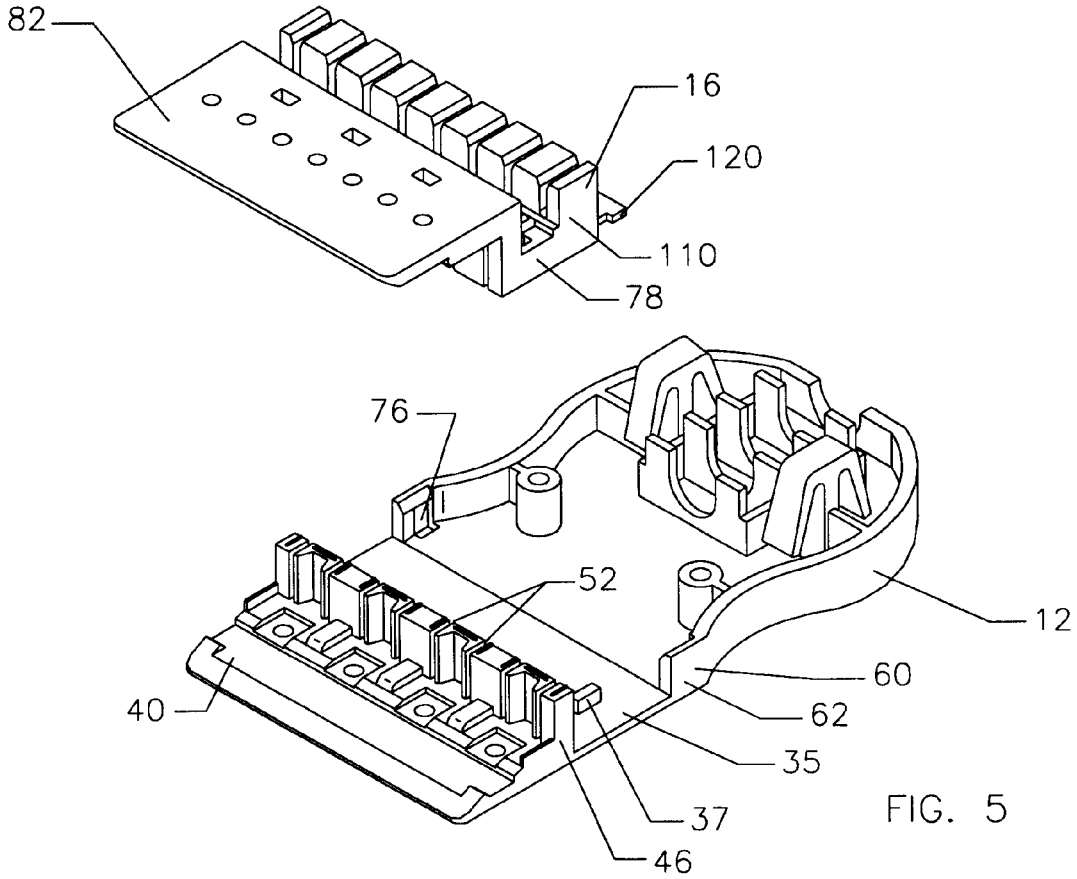
FIG. 5 is a perspective view of the housing base and unassembled contact carrier according to the present invention.

With reference to FIGS. 2 and 5, assembly of the housing base 12 and contact holder 16 will now be described. First, the contact pins 22 (not shown in FIG. 5) are inserted into the grooves 84, 86 of the contact holder with the insulation displacement connectors of the contact pins inserted through the openings 108 in the bottom plate into the widened slots 105 of the contact protection block 100. Next, the bottom plate 78 of the contact holder is pressed toward the flat intermediate portion 35 of the housing base between the contact support 46 of the housing base and the outer wall 60 of the housing base. As the contact holder is pressed toward the housing base, the contact blades are positioned within the slots 52 of the contact support of the housing base. When assembled, the posts 37 of the housing base are located in the holes 118 of the contact holder, the protrusions 94 on the rear wall 80 of the contact holder are snapped into recesses 58 of the contact support of the holder base (see FIG. 6), and the laterally extending latches 120 are engaged in the recesses 76 of the housing base. Preferably, when assembled, an exterior surface 110 of the end walls of the contact protection block are flush with the exterior wall surface 62 of the outer wall of the housing base. In addition, the upper lip 82 and the lower lip 40 define the opening 21 that exposes the contact blades 26 for insertion into the 110-type connector block of the cross-connect panel (see FIG. 1).

Figure 7A:
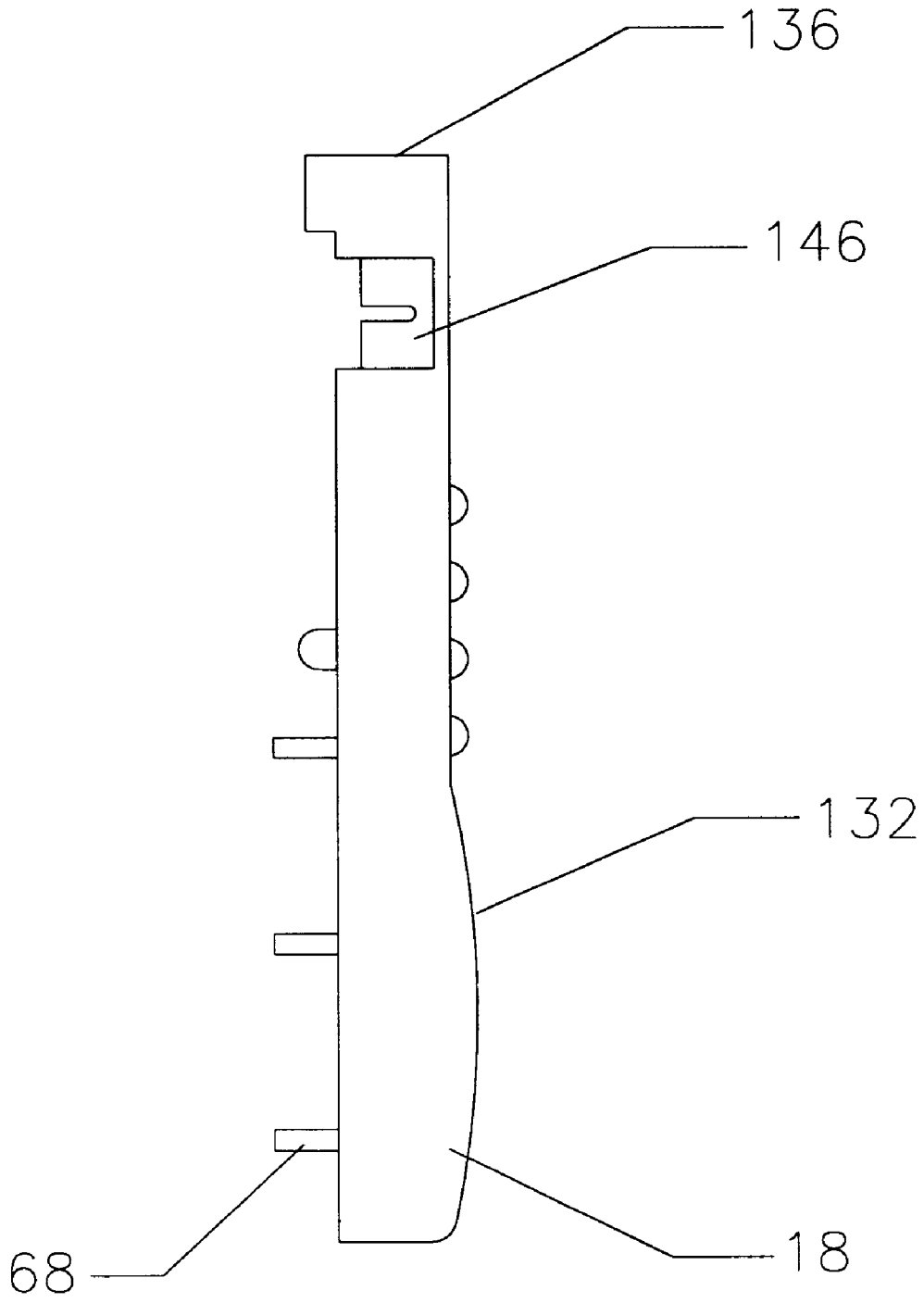
FIG. 7A is a side view of a cover of the patch plug according to the present invention.
Figure 7B:
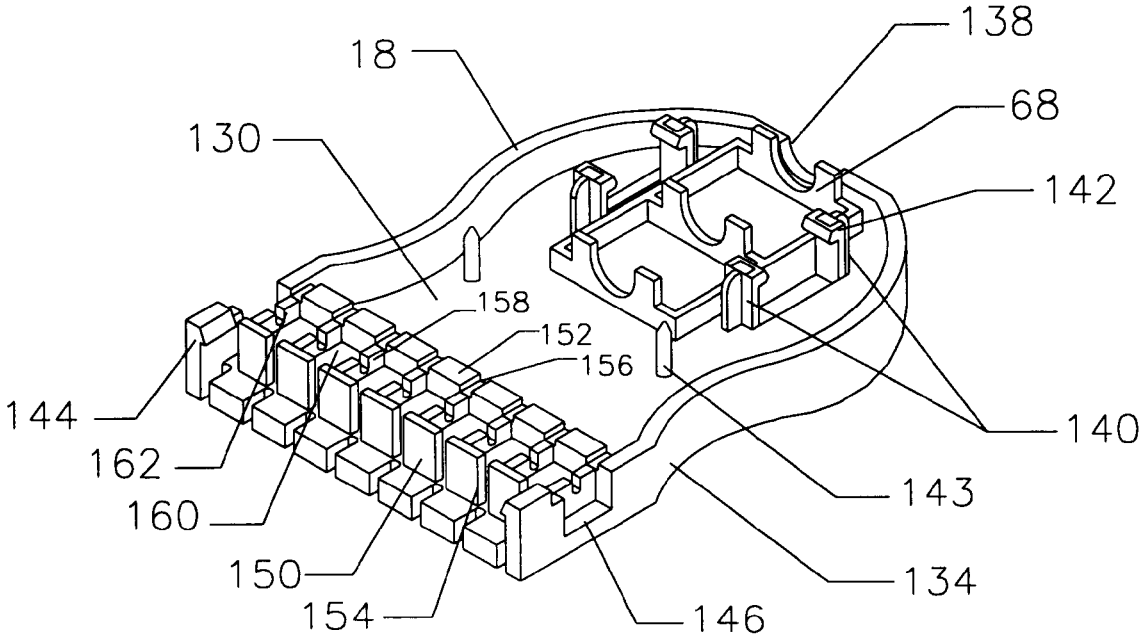
FIG. 7B is a perspective view of the inside surface of the cover of FIG. 7A.

With reference also to FIGS. 7A and 7B, the cover (or termination cap) 18 has an interior surface 130, an exterior surface 132 and an outer wall 134 around the periphery of the cover except for a front end 136 thereof. At its back end, the outer wall 134 has a semicircular cutout 138 for receiving the cord 20. Inwardly from the cutout are a plurality of longitudinally spaced U-shaped uprights 68 that provide strain relief to the cord when opposed to the similar uprights 66 of the housing base (see FIG. 11). Extending outwardly from the interior surface of the cover on each side of the U-shaped uprights is a pair of brackets 140 each bracket having a protruding lip 142 for engaging the free ends of the resilient arms 72 that are mounted to the housing base.

Preferably, a pair of elongated pins 143 extend outwardly from the interior surface of the cover and are aligned with base alignment holes 74 of the housing base to align the cover and the housing base during assembly. In addition, latches 144 are provided on the inner surface of the outer wall adjacent the front end 136 of the cover to assist in latching the cover to the contact holder. The outer wall of the cover also preferably includes a cutout 146 on each side adjacent the front end to receive the end walls of the contact protection block when assembled.

The interior surface of the cover is provided with longitudinally spaced front and rear wire guides 150, 152 defining a plurality of front and rear wire grooves 154, 156. Termination bars 158 are aligned with the front and rear wire grooves between the front and rear wire guides to assist the cover in forcing the insulated wires down to the proper depth inside the contact protection block to ensure insulation displacement and proper contact with the contact pins. Recesses 160 between the termination bars provide clearance for the top of the contact protection block. The termination bars each also have a cutout 162 to provide clearance for the insulation displacement connectors of the contact pins.

Figure 8:
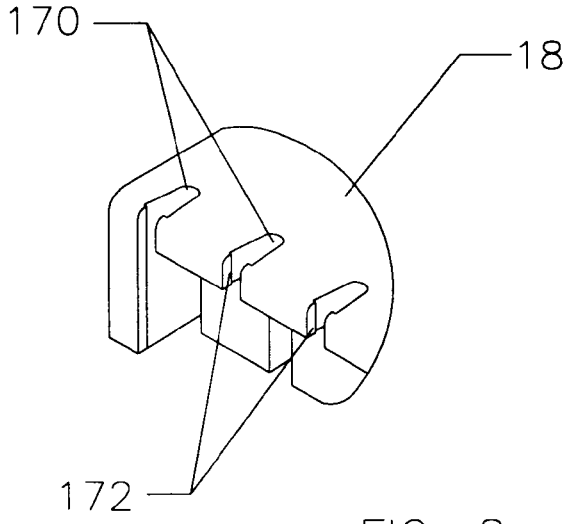
FIG. 8 is an enlarged perspective detail of the cover according to the present invention.

With reference to FIG. 8, the exterior surface of the front end of the cover 18 has a plurality of wire channels 170 to guide and organize the wires and to provide strain relief. In the preferred embodiment, the wire channels 170 have small tabs 172 at their open ends, which reduce the likelihood that the insulated wires will come out of the channels after installation. The wire channels reduce the necessity for precise trimming of the wires and also permits daisy chaining to an additional patch plug, if desired.

With reference to FIGS. 7B and 9, assembly of the cover 18 to the housing base 12 and the contact holder 16 will now be described. The cover is first positioned above the housing base with the elongated pins 143 aligned above the base alignment holes 74. The cover is then guided toward the housing base until the brackets 140 engage the outwardly extending resilient arms 72. Further downward movement of the cover causes the resilient arms to deflect inwardly until the resilient arms snap behind the protruding lips 142 of the brackets. At the same time, the latches 144 of the cover engage the protrusions 116 on the flanges 114 of the contact holder retaining the cover in place.

Manual termination of the insulated wires to the IDCs in the contact protection block may be achieved by inserting the individual wires (not shown) through the wire grooves 154, 156 of the cover. The wires may then be inserted up through the wire channels 170 through the exterior surface of the cover without the necessity of precise trimming. Each insulated wire will pass over a respective termination bar 158 of the cover. Wire termination is achieved by pushing the cover onto the contact protection block 100 of the contact holder as discussed above. If desired, pliers may be used to generate the necessary force to cause the insulation displacement connectors of the contact pins to cut through the insulation of the wires and make proper contact.

Alternatively, termination may be achieved by using a punchdown tool 102. In this case, the insulated wires are inserted directly into the slots 106 of the contact protection block, then pushed down and simultaneously cut with the punchdown tool. The tool block 112 along the front of the contact protection block serves as a sturdy base for cutting by the punchdown tool. After the wires have been terminated, the cover may be assembled to the contact protection block, taking care to position the insulated wires into the proper slots of the cover. In this instance, the cover serves to retain the wires in place and to provide strain relief. The punchdown tool described herein is a standard tool that is well known in the industry.

Figure 10:
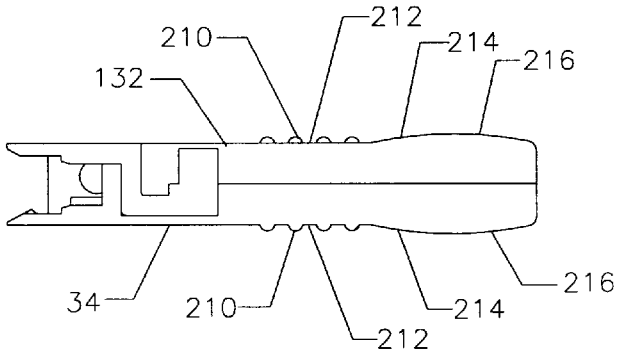
FIG. 10 is a side view of the patch plug shown in FIG. 1.

With reference to FIG. 10, the exterior surface 34 of the housing base and the exterior surface 132 of the cover are each provided with a grip relief 210 which provides a gripping surface to assist a user in removing and reinstalling a patch plug to a cross-connect panel as desired. The grip relief is preferably provided at intermediate portions 212 of the housing base and cover. Rearwardly of the grip reliefs, the exterior surfaces of the housing base and cover may be provided with a gradual incline or ramp surface 214, thus increasing the thickness of the patch plug in the longitudinal direction from the intermediate portion to a rear portion 216 of the patch plug. The ramp surface is to be distinguished from the grip reliefs 210, which do not as a whole provide a gradually inclining surface or a smooth surface against which a pulling force may be applied. The grip reliefs result in a higher concentrated force being applied to the thumb or finger of a person pulling on the patch plug than that which would be applied by the ramp surface.

From the foregoing, it will be appreciated that the patch plug of the present invention has a contact protection block that protects the insulation displacement connectors of the contact pins from damage, despite the limitation on width size of patch plugs that are used on 110-type connector blocks. The patch plug also has ramped surfaces extending longitudinally which permit easier grasping and removal of the patch plug from the 110-type connector block even when many patch plugs are mounted side-by-side. The patch plug of the present invention is also easily installed in the field either via cover termination or tool termination.

While a particular form of the invention has been illustrated and described, it will be apparent that various modifications can be made without departing from the spirit and scope of the invention. In particular, while the patch plug has been described with regard to a four pair patch, the present invention may also be configured in any other required configuration, including one, two or three pair configurations. Accordingly, it is not intended that the invention be limited except by the appended claims.

I claim:

1. A patch plug for connecting a plurality of communication wires to a plurality of first insulation displacement connectors, comprising:

a plurality of spaced-apart electrical contacts, each one of said plurality of spaced-apart electrical contacts having a front end forming a contact blade and a back end forming a second insulation displacement connector, each of the second insulation displacement connectors being adapted to receive, in conductive engagement, a respective one of the plurality of communication wires, each contact blade being adapted for insertion into a respective one of said plurality of first insulation displacement connectors; and a dielectric housing containing the plurality of spaced-apart electrical contacts and maintaining the contacts aligned in predetermined positions such that the second insulation displacement connectors are disposed rearwardly of their respective blades, arranged upwardly, and aligned in a row transverse to the direction of insertion of the contact blades;

wherein the dielectric housing includes a termination cap and a remaining portion that holds the plurality of spaced apart electrical contacts prior to the assembly of the termination cap, the remaining portion having a contact protection block formed around the row of second insulation displacement connectors, the contact protection block having two outer side walls, one at each end of the row of second insulation displacement connectors, and intermediate walls located between and extending above the second insulation displacement connectors of adjacent contacts, the contact protection block defining a plurality of slots, each one of said plurality of slots for receiving and guiding a respective one of said plurality of communication wires into conductive engagement with the second insulation displacement connector of each one of said plurality of spaced-apart electrical contacts.

2. The patch plug of claim 1, wherein the contact protection block, measured from one of the two outer side walls to the other of the two outer side walls, extends the full width of the patch plug.

3. The patch plug of claim 1, wherein the outer side walls of the contact protection block form an exterior surface of the patch plug when the patch plug is fully assembled.

4. The patch plug of claim 1, wherein the dielectric housing has a rear wall spaced a sufficient distance in front of the contact protection block to permit insertion between the rear wall and the contact protection block of a punchdown tool for cutting each of the plurality of communication wires after they are located in conductive engagement with the second insulation displacement connectors.

5. The patch plug of claim 1, wherein the the remaining portion includes a housing base and a contact holder that includes the contact protection block, and the plurality of spaced-apart electrical contacts are located within the dielectric housing between the housing base and the termination cap.

6. The patch plug of claim 5, wherein each outer side wall of the contact protection block has an exterior surface that is flush with an exterior surface of the remainder of the dielectric housing.

7. The patch plug of claim 5 further comprising strain relief means within the dielectric housing for forming a wave in a cord containing the plurality of communication wires.

8. The patch plug of claim 5, wherein the dielectric housing includes a front end having a lower lip and an upper lip that define an opening for receiving the plurality of first insulation displacement connectors.

9. The patch plug of claim 8, wherein the housing base, the contact holder and the termination cap are separate pieces, the lower lip is part of the housing base, and the upper lip is part of the contact holder.

10. The patch plug of claim 5, wherein the termination cap has an upper exterior surface having a front end that defines a plurality of wire channels to permit the plurality of communication wires to be inserted into the wire channels and through the upper exterior surface of the termination cap.

11. The patch plug of claim 10, wherein at least one of the plurality of wire channels includes tabs at its open end to reduce the likelihood that a communication wire located in said one wire channel will come out of said one wire channel after being inserted therein.

12. The patch plug of claim 6, wherein the termination cap has an upper exterior surface that extends rearwardly of the plurality of spaced-apart electrical contacts, the housing base has a lower exterior surface that extends rearwardly of the plurality of spaced-apart electrical contacts and wherein the upper and lower exterior surfaces gradually diverge from each other in a rearwardly direction.

13. The patch plug of claim 12, wherein the upper exterior surface and the lower exterior surface gradually incline from a location rearward of the contact protection block to a location adjacent a rear end of the patch plug to permit a pulling force to be applied to each of said upper and lower exterior surfaces.

14. The patch plug of claim 5, wherein the dielectric housing has a rear wall spaced in front of the contact protection block and the termination cap has an outer wall located between the rear wall and the contact protection block when the patch plug is assembled.

15. The patch plug of claim 14, wherein the outer wall of the termination cap is latched to the remainder of the dielectric housing at a location between the rear wall and the contact protection block.

16. A method of terminating a plurality of communication wires to a patch plug for connection to a plurality of first insulation displacement connectors, comprising:

providing a plurality of spaced-apart electrical contacts, each one of said plurality of spaced-apart electrical contacts having a front end forming a contact blade and a back end forming a second insulation displacement connector, each of the second insulation displacement connectors being adapted to receive, in conductive engagement, a respective one of the plurality of communication wires, each contact blade being adapted for insertion into a respective one of said plurality of first insulation displacement connectors;

providing a dielectric housing containing the plurality of spaced-apart electrical contacts and maintaining the contacts aligned in predetermined positions such that the second insulation displacement connectors are disposed rearwardly of their respective blades, arranged upwardly, and aligned in a row transverse to the direction of insertion of the contact blades and wherein the dielectric housing includes a termination cap and a remaining portion that holds the plurality of spaced apart electrical contacts prior to the assembly of the termination cap, the remaining Portion having a contact protection block formed around the row of second insulation displacement connectors, the contact protection block having two outer side wall, one at each and of the row of second insulation displacement connectors, and intermediate walls located between and extending above the second insulation displacement connectors of adjacent contacts, the contact protection block also defining a plurality of slots, each one of said plurality of slots for receiving and guiding a respective one of said plurality of communication wires into conductive engagement with a second insulation displacement connector of each contact; and terminating respective ones of said plurality of communication wires into conductive engagement with respective ones of the second insulation displacement connector of each contact.

17. The method of claim 16, wherein the dielectric housing has a rear wall spaced a sufficient distance in front of the contact protection block to permit insertion of a punchdown tool and further comprising;

inserting the punchdown tool between the rear wall and the contact protection block to cut each one of the plurality of communication wires that have been terminated in the second insulation displacement connectors.

18. The method of claim 16 wherein the termination cap has an upper exterior surface having a front end that defines a plurality of wire channels to permit the plurality of communication wires to be inserted into the channels and through the upper exterior surface of the termination cap and further comprising inserting the plurality of communication wires into respective ones of the plurality of wire channels before terminating the respective ones of said plurality of communication wires.

* * * * *